United States Patent [19]

Benassi

[11] 3,938,125

[45] Feb. 10, 1976

[54] ANTIPILFERAGE SYSTEM AND MARKER THEREFOR

[75] Inventor: Dominic A. Benassi, St. Paul, Minn.

[73] Assignee: Minnesota Mining and Manufacturing Company, St. Paul, Minn.

[22] Filed: Feb. 20, 1974

[21] Appl. No.: 443,954

[52] U.S. Cl. ..... 340/280; 29/197; 29/199; 324/41; 340/258 R; 343/6.5 SS

[51] Int. Cl.[2] ..... G08B 13/24

[58] Field of Search ..... 340/258 R, 258 C, 280; 343/787, 6.5 SS, 6.8 R; 324/3, 41; 29/197, 199, 194

[56] References Cited

UNITED STATES PATENTS

| | | | |
|---|---|---|---|
| 3,321,328 | 5/1967 | Koretzky | 29/197 X |
| 3,448,440 | 6/1969 | Wiegand | 343/6.8 R |
| 3,512,946 | 5/1970 | Hutkin | 29/199 X |
| 3,534,358 | 10/1970 | Stern | 340/280 |
| 3,594,290 | 7/1971 | Jostan | 29/199 X |
| 3,665,449 | 5/1972 | Elder et al. | 324/41 X |
| 3,686,564 | 8/1972 | Mallick et al. | 340/258 C |
| 3,697,972 | 10/1972 | Brown | 340/258 C |
| 3,747,086 | 7/1973 | Peterson | 340/258 R |
| 3,763,424 | 10/1973 | Bennett et al. | 340/258 C |
| 3,765,007 | 10/1973 | Elder | 340/258 R |
| 3,820,104 | 6/1974 | Fearon | 340/280 |

*Primary Examiner*—David L. Trafton
*Attorney, Agent, or Firm*—Alexander, Sell, Steldt & DeLaHunt

[57] ABSTRACT

An antipilferage system utilizing markers comprising a sheet having both ferromagnetic and electrically conductive characteristics, which markers are detected upon passage through an interrogation zone within which are sequentially generated magnetic fields orthogonally disposed with respect to each other. The marker sheet is preferably a laminate of a ferromagnetic layer and a conductive metal layer, each of which layers exhibits a maximum sensitivity to fields perpendicular to each other. Interrogation of the markers by fields in three dimensions ensures the production of signal components associated with both characteristics of the marker regardless of the orientation of the marker upon passage through the zone. Accordingly, a highly reliable and false alarm free system is provided.

8 Claims, 4 Drawing Figures

ANTIPILFERAGE SYSTEM AND MARKER THEREFOR

BACKGROUND OF THE INVENTION

1. Field of the Invention

This invention relates to antipilferage systems and markers for use therein. In particular, it relates to such markers as produce a response to an alternating magnetic field.

2. Description of the Prior Art

Antipilferage systems relying on magnetic principles have long been known. Such systems are generally of two types, those such as are disclosed in U.S. Pat. Nos. 3,534,358 (Stern) and 3,559,201 (Hillard) which utilizes a marker comprising a nonmagnetic metallic foil such as aluminum, and those such as are disclosed in U.S. Pat. Nos. 3,292,080 (Trikilis) and 3,665,449 (Elder & Wright), which utilize a marker comprising a ferromagnetic material. In all such systems, the marker is essentially insensitive in at least one direction. A variety of schemes have been proposed to overcome this limitation: some provide a multidimensional shaped marker such as an L shape, while others provide multidirectional interrogating fields and sensors sensitive to fields along more than one axis. Systems using nonmagetic metal foils are still prone to false alarms resulting from the presence of other metallic objects such as briefcases, keys, etc. being carried through the interrogation zone. Systems based on magnetic markers have the disadvantage of being subject to false alarms due to the presence of extraneous magnetic materials.

SUMMARY OF THE INVENTION

Improved reliability over that of the aforementioned prior art systems is provided by a marker comprising a sheet including a laminate of a ferromagnetic layer and an electrically conductive layer wherein the ferromagnetic layer is characterized by an initial relative permeability in excess of 20,000, a maximum relative permeability in excess of 100,000 and a coercivity less than 0.3 $\sigma$e, and wherein the electrically conductive layer is characterized by a resistivity of not greater than about 3.0 microhm-cm. The sheet responds to interrogating magnetic fields sequentially applied along three axes, preferably orthogonally to each other, within an interrogation zone, thereby ensuring reliable detection of the marker regardless of the orientation of the marker within the zone. The magnetic and conductive characteristics of the sheet are such that a sequence of signals are cooperatively produced in response to the sequentially applied fields, at least one signal being attributable to the magnetic characteristic and one signal being attributable to the conductive characteristic. A requirement that at least both signals be present thus prevents false alarms produced by signals resulting from only the presence within the zone of a sheet or an equivalent material possessing only one of the characteristics.

The marker responds to a uniaxial interrogating magnetic field in two ways: Firstly, eddy currents are induced in the sheet due to its conductive characteristics when the sheet is oriented to intercept the lines of flux associated with the field. The eddy currents set up a second magnetic field which opposes the interrogating field producing the eddy currents. The resultant perturbation of the magnetic field within the interrogation zone is sensed by magnetic field sensors adjacent the interrogation zone. A maximum response resulting from the eddy currents occurs when the plane of the sheet is normal to the direction of the field. Secondly, the ferromagnetic characteristics of the sheet result in a strong magnetic field being produced in the sheet in response to the interrogating magnetic field. Thus, when the plane of the sheet (i.e. the dimension with the minimum demagnetizing factor) is oriented parallel to the axis of the field, a condition of maximum field intensity exists within the sheet, resulting in a condition of maximum external dipole moment. If the sheet is centered within the field, the effect of such a dipole moment may be undistinguishable. However, when the sheet is positioned even slightly off of the center of the field, the dipole moment associated with the sheet unbalances the field, thereby resulting in a response in the field sensors.

DESCRIPTION OF THE PREFERRED EMBODIMENT

Figure 1:
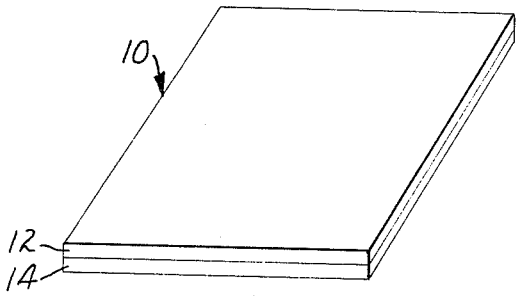
FIG. 1 is a three dimensional view of a marker of the present invention.

FIG. 1 shows a three dimensional view of a marker according to a preferred embodiment of the present invention. The marker 10 comprises a laminate of a layer such as a sheet 12 of a ferromagnetic material (e.g., permalloy) and a layer such as a sheet 14 of a conductive material (e.g., aluminum foil). The marker may have additional outer layers to provide printable and/or protective surfaces, and may further be adapted for securing the markers to objects. Such securing means may comprise layers of pressure-sensitive adhesives, mechanical fasteners and the like.

While the size of the marker 10 is not overly critical, the larger the size, the larger the corresponding signal produced upon interrogation will be. Similarly, a larger signal is produced for a square than for a strip shaped marker since eddy currents in a conductive strip are substantially reduced. Accordingly, a marker on the order of 1 inch square is preferred for use with an interrogating field varying at a frequency of approximately 10 KHz. It is further preferred that the sheets 12 and 14 be continuous. The signal produced from cut or multiple sheets is less than that from a single sheet even though the total surface area of the conductive sheet is the same. Such cuts represent high impedances that restrict the flow of eddy currents and thereby lessen that signal component associated with such eddy currents.

The induced eddy currents in the conductive sheet 14 correspond to the flow of induced electrical charges which are produced as a result of the interaction of the conductive sheet with the interrogating magnetic field. The magnitude of the induced charges is related to the intensity of the applied field and to the dimensions and conductivity of the sheet in a manner well known to those skilled in the art, and assumes a polarity minimizing the total magnetic flux, i.e., the field produced by the eddy currents "bucks" that of the interrogating field. Accordingly, a maximum intensity signal is produced upon interrogation of the conductive component of the marker by fields applied perpendicular to the plane of the conductive sheet. The signal corresponds to a diminishment of the applied fields, which diminishment is substantially in phase with the applied fields. Although aluminum foil sheets are preferred for use as the conductive layer in the markers of the present invention due to their low cost, availability and high conductivity, other conductive metals such as Cu, Ag and Au, i.e., having a resistivity of not greater than about 3.0 micro ohm-cm may also be used. A single sheet having the requisite ferromagnetic and high electrical conductance characteristics is similarly suitable.

The ferromagnetic sheet 12 is preferably selected to have a relatively high permeability when in a demagnetized condition and to have a very low permeability when in a magnetized state. For a permalloy type material, the initial relative permeability is desirably in excess of 20,000, the maximum relative permeability, in excess of 100,000, and the coercivity very low (i.e., less than 0.3 Oe.). The saturation magnetization of such sheets should be sufficiently high to prevent saturation by the interrogating fields normally used to monitor the presence of a marker in the interrogation zone. Materials such as Permendur (50—50 iron and cobalt) have such a high saturation magnetization (24,500), but are not as desirable due to their low permeability. A particularly preferred ferromagnetic material is Supermalloy, an alloy of 5 wt.% Mo, 79 wt.% Ni, and 16 wt.% Fe, having an initial relative permeability of approximately 100,000, a maximum relative permeability of approximately 1,000,000, an extremely low coercive force (i.e., $H_c \approx 0.002$ Oe.), and a saturation magnetization of approximately 7,900 gauss.

The magnetization of the ferromagnetic sheet produces an enhancement of the interrogating fields, which enhancement is maximized along the plane of the sheet. Due to hysteresis effects in the ferromagnetic sheet, this enhancement is approximately 90° out-of-phase with the applied field, the extent of phase shift being dictated by the intensity of the applied field and the magnetic parameters of the ferromagnetic sheet. Accordingly, signals as are produced in magnetic sensors positioned proximate an interrogation zone due to the ferromagnetic component of a marker in the zone may be distinguished from those due to the conductive component by comparing the instantaneous phase of the signal with that of the applied field.

The shape of the ferromagnetic sheet 12 is subject to fewer constraints than that of the conductive sheet 14. It has been found that even a relatively small square of permalloy will develop a satisfactory signal irrespective of the orientation of the sheet with respect to a uniaxial interrogating field. However, a maximum signal has been found to result when the plane of the sheet is oriented along the axis of the interrogating field, since in that orientation a maximum magnetic flux density is induced. Since such maximum signals are developed in spite of the large demagnetizing factor normal to the plane of the square sheets, the signal is not believed dependent upon the saturation or "switching" of the ferromagnetic material, but rather upon the change in the total dipole moment induced in the sheet by the interrogating field.

When a ferromagnetic, (e.g., permalloy) sheet is oriented perpendicular to a uniaxial interrogating field, the signal from the ferromagnetic sheet has been found to be less than that produced from a similarly oriented conductive, (e.g., aluminum) sheet of the same size and shape, since in that orientation the demagnetizing effects are maximized and since the signal component produced as a result of eddy current contributions in the less conductive ferromagnetic sheet are substantially less than that produced by the highly conductive, (e.g., aluminum) sheet.

As an alternative to the directly laminated layers in the form of the sheets 12 and 14 shown in the preferred embodiment of FIG. 1, an insulating layer may be placed between the sheets 12 and 14. Alternatively, surfaces of one or both of the sheets may become oxidized and thereby provide an insulated layer. The presence of such insulating layers has been found to make little or no difference in the signal output.

A preferred embodiment of the marker of the present invention is in the form of a flat laminate such as depicted in FIG. 1. However, if the object to be detected inherently possesses magnetic or conductive properties, such properties may be utilized in lieu of providing the marker with a sheet having corresponding properties. In such an event, the marker affixed to that object would need only have a single layer providing that response which is lacking in the object itself. Thus, for example, it has been found that a magnetic object such as one made out of soft iron or steel causes an appreciable signal. However, the amplitude of the signal is still dependent upon the orientation of the magnetic object in the interrogating magnetic field. Accordingly, steel tools, guns and like magnetic objects may be satisfactorily detected by affixing a marker comprising only a sheet of aluminum foil to such objects.

Figure 2:
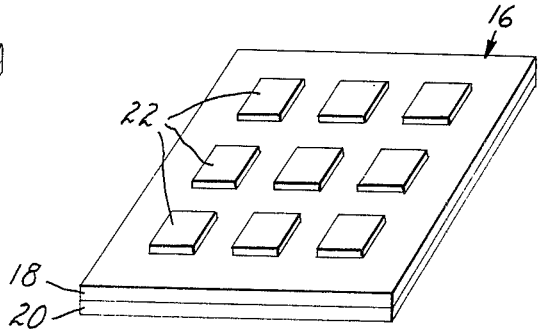
FIG. 2 is a three dimensional view of a desensitizable marker of the present invention.

For certain applications, it is desirable to have the marker permanently attached to the object to be protected and to have the capability of rendering the marker inoperative during the time that a legitimate borrower or buyer is in possession of the article. Such an arrangement is advantageous in the case of a library, warehouse, store, etc., where objects are protected by markers permanently secured thereto, and where the marker is not easily removed or rendered inoperative except by means of a checkout device controlled by the librarian, owner, or custodian after the prospective buyer or borrower has made satisfactory arrangements. Accordingly, another embodiment of the present invention shown in FIG. 2 provides a marker 16 having a ferromagnetic sheet 18, such as permalloy, a conductive sheet 20, such as aluminum, and small magnetizable elements 22. Such elements 22 are preferably made of a ferromagnetic material having a higher coercivity than that possessed by the ferromagnetic sheet 18. The characteristics of such elements are further set forth in U.S. Pat. No. 3,665,449, which patent is assigned to the assignee of the present invention and which disclosure is fully incorporated by reference herein.

When the elements 22 are permanently magnetized, thereby greatly decreasing their permeability, the magnetic fields associated with such magnetization will "bias" the ferromagnetic sheet 18 and thereby alter its response to an interrogating field. Normally, the ferromagnetic sheet 18 is unbiased, i.e., in its high permeability state, and thereby has a pronounced effect upon the applied interrogating fields. When it is desired to render the marker inoperative so that the protected objects may pass through the interrogation zone without triggering an alarm, the ferromagnetic sheet 18 is magnetically biased or desensitized by magnetizing the elements 22 to greatly reduce the effective permeability of the ferromagnetic sheet 18. Such a reduction in permeability drastically decreases the effect of the composite marker on the interrogating field. The biasing makes the ferromagnetic sheet 18 look like a smaller part of a magnetic circuit and therefore less able to distort or reshape the interrogating field. The induced eddy current fields associated with the conductive sheet 20 are not affected by such magnetic biasing.

In order to reliably discern a marker regardless of its orientation in an interrogation zone and in order to reliably discriminate between such markers and other metallic or magnetic articles, the markers of the present invention are required to produce signals resulting from both the magnetic and conductive metal sheets. The relative freedom from flase alarms thus achieved is a most important attribute of the present invention. Because of the large mass or large associated fields of some magnetic objects, more energy absorption or distortion of the interrogating magnetic fields may result from the presence of such objects than is produced by the markers of the present invention. Nonetheless, false alarms are prevented since the great majority of such objects do not contain both magnetic and highly conductive components in parallel sheet form. Furthermore, since such objects will generally distort the field in a different manner than that of the ferromagnetic sheets of the present invention, signal processing techniques based on the frequency characteristics of the signal may be used to enable the production of an alarm signal only when two parallel sheet components of the marker are present.

An important attribute of the markers of the present invention such as those shown in FIGS. 1 and 2 and is that the maximum response produced from the ferromagnetic component results when the plane of the ferromagnetic sheet lies parallel to a uniaxial interrogating field, whereas the maximum response associated with the conductive metal sheet occurs when the plane of the conductive sheet is perpendicular to such an interrogating field. The orientation of the marker will normally not change while the marker is passing through an interrogation zone, thus in order to reliably produce signals associated with both the magnetic and conductive metal components of the marker, uniaxial magnetic interrogating fields from at least three directions must be produced in the interrogation zone. Accordingly, in FIG. 3 there is shown a system having an interrogation zone 24 such as a corridor or passageway along which objects 26 within which a marker 28 is concealed would be carried. The interrogation zone 24 has impressed thereon in a sequential manner three interrogating fields together constituting a sequence frame, each field being substantially unidirectional, having its axis orthogonally disposed with respect to the other two fields. Such fields may be generated by orthogonal $x$, $y$ and $z$ transmitting antennas 34, 36, and 38 respectively when suitably energized by signal generating apparatus 30 in a manner well known to those skilled in the art. Field generating circuits and apparatus such as are disclosed in U.S. Pat. Nos. 3,665,449 and 3,697,996, which disclosures are incorporated herein by reference, are especially preferred for use in the present invention. In a preferred embodiment, the signal generating apparatus 30, when energized, provides a sinusoidal signal varying at a frequency of approximately 10 KHz. This signal is coupled to a field sequence control network 31 and to the interrogating field gate enable circuits 32. The field sequence control network 31 sequentially couples the signal from the signal generator 30 through the gate enable circuits 32 to the orthogonal $x$, $y$ and $z$ transmitting antennas 34, 36 and 38 respectively.

Corresponding to the $x$, $y$ and $z$ transmitting antennas 34, 36 and 38 respectively, the system further includes in the vicinity of the interrogation zone 24 $x$, $y$ and $z$ axis receiver antennas 40, 42 and 44 respectively. Each receiver antenna is positioned with respect to a corresponding transmitting antenna such that it is in electrical balance with the magnetic field produced by the corresponding transmitting antenna. For example, the $x$ transmitting antenna 34 and the $x$ receiving antenna 40 are disposed to provide minimum magnetic coupling under balanced conditions, i.e., when no marker is present in the zone, and are physically arranged to best utilize the space available within the interrogation zone 24. The $y$ transmitting antenna 36 and $y$ receiving antenna 42 as well as the $z$ transmitting antenna 38 and $z$ receiving antenna 44 are similarly disposed. In a preferred embodiment, the receiver antennas are simple sensor coils, each having a single axis of maximum sensitivity, and are placed adjacent the midpoint of the interrogation zone with each axis of maximum sensitivity oriented perpendicular to the corresponding applied field to provide the minimum magnetic coupling. The presence of a marker in the zone is then sensed by the unbalance created by either the eddy current or magnetization effects. In a similar manner, pairs of series-opposition connected coils, Hall-sensors and other magnetic sensors may be placed in electrical balance and utilized in lieu of simple sensor coils. In the single sensor coil embodiment, an $x$ axis transmitting antenna is associated with a corresponding $x$ axis receiving antenna having a maximum sensitivity in the $y$ or $z$ direction. Similarly, the $y$ transmitting antenna is associated with the $y$ axis receiving antenna, etc. For simplicity, a preferred embodiment provides as the $x$ axis receiver antenna a coil having a maximum sensitivity along the $y$ axis, the $y$ axis receiver antenna having a maximum sensitivity along the $z$ axis and the $z$ axis receiver antenna having a maximum sensitivity along the $x$ axis.

Signals from the respective receiver antennas are coupled through the receiver antenna gate enable circuits 46 which are synchronized by the field sequence control network 31 to pass signals from each receiver antenna only while its associated transmitting antenna is energized. Signals passing through the gate enable circuits 46 are coupled to the pulse decoding network 48, which compares the timing of the respective signals with the phase of the signals produced by the signal generator 30 to provide "in-phase" and "out-of-phase" signals on leads 50 and 51. These signals are coupled to the alarm logic network 52, which network is synchronized by a signal derived from the field sequence control network 31 through the F/3 circuit 53 to indicate the duration of a sequence frame. Upon detection of a requisite number and sequence of in-phase and out-of-phase signals, the alarm logic network 52 produces an alarm signal which is coupled to the output alarm network 54.

These circuits and networks are of conventional design and need no further description. Such circuits need only be able to discriminate the signals produced by the presence of the markers in the interrogation zone from signals resulting from changes in the quiescent magnetic field intensities of the interrogating fields, changes in the environmental magnetic fields, and the usual electromagnetic noises. If desired, such capabilities may be optimized by providing regulating feedback circuits to compensate for changes in quiescent conditions.

Operationally, when a marker is brought into the zone such that the plane of the marker is perpendicular to one axis, e.g., the $x$ axis, and an interrogating field is applied along the $x$ axis, i.e. by energization of the $x$ axis antenna 34, conditions favoring the propagation of eddy currents prevail. Accordingly, the field in the zone is diminished by the "bucking" field associated with such currents, with the diminishment being substantially in phase with the applied field. Such effects on the applied field may be detected by a receiving antenna oriented to sense deviations from the normal intensity of the applied field. However, it is preferred to sense the effects as an "in-phase" unbalanced condition in an antenna orthogonally disposed with respect to the applied field, such as the $x$ axis receiver antenna 40, with the $x$ axis receiver antenna 40 being switched on when the $x$ axis transmitting antenna 34 is energized.

During the time the marker is in the zone, the remaining $y$ and $z$ axis fields are successively produced by sequentially energizing the $y$ and $z$ axis transmitting antennas 36 and 38 respectively. Thus, when the $y$ axis field is energized, a maximum flux will be produced in the ferromagnetic sheet since the plane of the marker lies in the $y$ axis. The resulting dipole moment produces an enhancement of the $y$ axis applied field, with the enhancement being approximately 90 degrees out-of-phase with the applied field due to hysteresis effects in the ferromagnetic sheet. The out-of-phase enhancement is then detected as an out-of-balance condition in the corresponding $y$ axis receiver antenna 42. Such detection has been found to be possible under all conditions except when the marker is precisely centered in the zone, thereby maintaining the electrical balance. Similarly, when the $z$ axis field is energized, a maximum flux will again be produced in the ferromagnetic sheet since the plane of the marker also lies in the $z$ axis, thus also producing an approximately 90° out-of-phase enhancement of the applied field which is detected in the corresponding $z$ axis receiver antenna 44.

Thus, during a succession of three sequential fields (i.e., one sequence frame) applied along the three axes and the associated sequential switching of the signals from each associated receiving antenna, a sequence of three signal components will be produced at the output of the receiver antenna gate enable circuits 46, one component being associated with an in-phase eddy current related diminishment of the field produced by the conductive sheet, a second component being associated with an out-of-phase field enhancement along one axis produced by the ferromagnetic sheet, and a third component being associated with a similar out-of-phase field enhancement along another axis.

In order to ensure reliable detection of the marker 28 in the zone 24, the pulse decoding network 48 is provided with additional signal processing circuits 56, 58, 60 and 62 respectively. The processed signals are then coupled to the alarm logic network 52, which produces an alarm signal only when the sequence of the in-phase and out-of-phase signal components is that produced by a three dimensional interrogation of the double sheet marker. Such interrogation must produce some sequence of one in-phase unbalance signal and two out-of-phase unbalance signals during each sequence frame, thus ensuring reliable detection of a marker in the interrogation zone.

Figure 3:
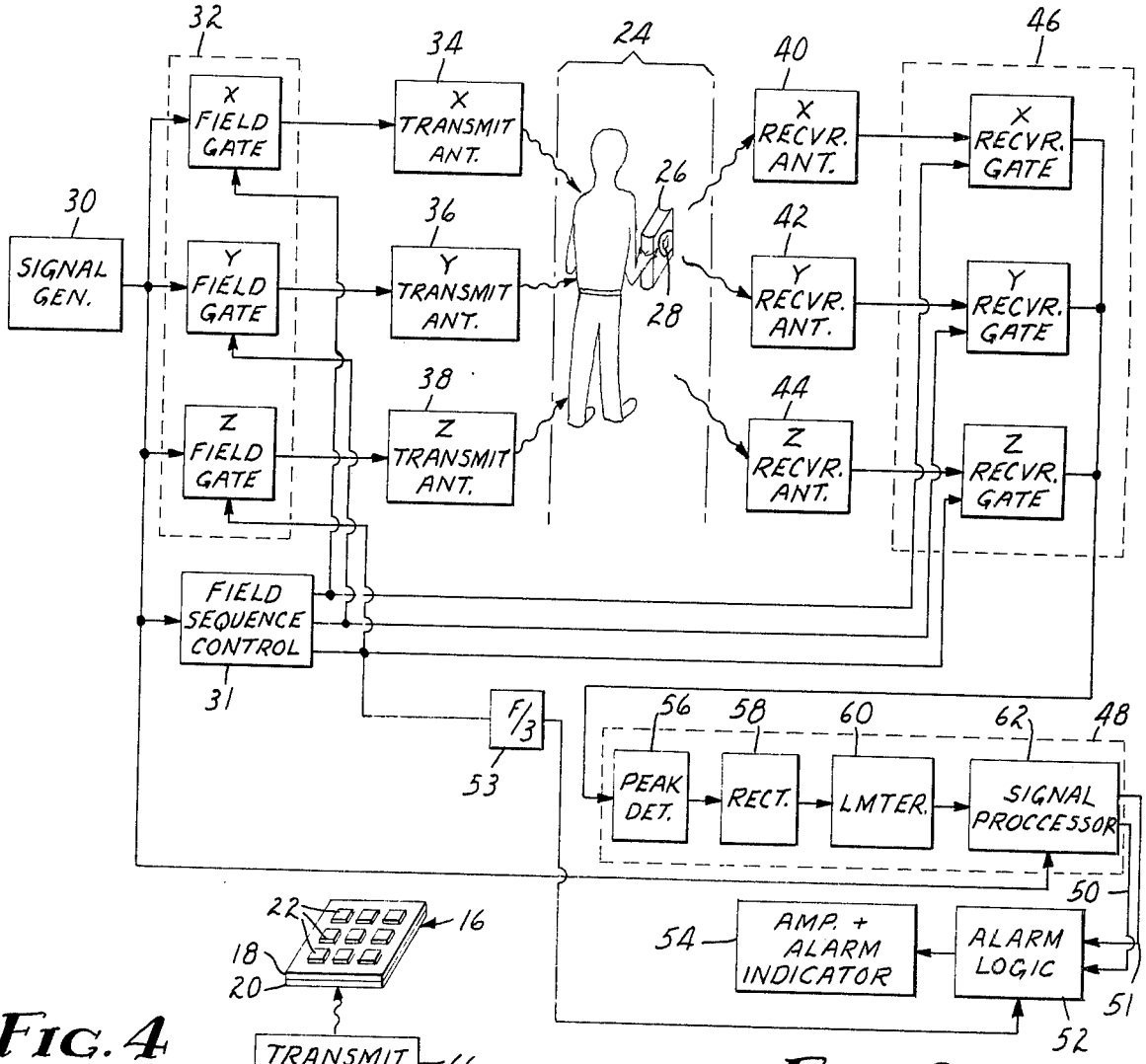
FIG. 3 is a block diagram of a preferred embodiment of a system for detecting the marker shown in FIGS. 1 and 2.

In a further embodiment also shown in FIG. 3, the sequentially applied fields are provided in the form of pulse bursts, the field along each axis being periodically varied during an interval typically extending 25–125 cycles (preferably 64) before oscillations from the signal generator 30 are switched by the field gate enable network 32 to another of the transmitting antennas. A sequence of three such bursts, each applied to a different antenna, constitutes a sequence frame. In such an embodiment, the presence of a marker in the zone causes a succession of in-phase and out-of-phase signals which are detected by the receiver antennas 40, 42 and 44 respectively. Accordingly, the pulse decoding network 48 is provided with a signal processing circuit 62 to recognize such successive in-phase and out-of-phase signals and to generate a single in-phase or out-of-phase signal in response to each succession of in-phase and out-of-phase signals.

The output signals are coupled to the alarm logic network 52 in the manner set forth hereinabove, whereupon the timing of the output signals occurring within one sequence frame is compared with the phase of the interrogating fields to produce an alarm indicating signal which may be used to activate the output alarm 64 in a conventional manner.

While the required sequence of one in-phase and two out-of-phase signals is most clearly produced when a marker is passed through the interrogation zone while oriented along one of the preferred directions, it has been found that any orientation will produce the required enhancement and diminishment in the manner set forth hereinabove. If a marker is oriented in the zone such that a plane of the marker intercepts the three fields causing a component of each field to be normal to the plane of the marker, interrogation by any one of the orthogonally disposed fields will produce the in-phase field diminishment signal components as well as the out-of-phase field enhancement signal components. In such an event, the resultant signal sequence is a simple alternation of in-phase and out-of-phase signal components, both of which are produced during each field alternation. Even allowing for the production of redundant signals to ensure reliability, reliable detection of the composite marker may still be accomplished with only one directional interrogating field so long as the field with respect to the plane of the marker has a component which exists in all three orthogonal directions. In such an embodiment, the respective receiver antennas sense both signal components during each field sequence. The logic network is then designed to detect the occurrence of both signal components during each field alternation. Should the marker be oriented so that the vector is parallel to the instantaneous interrogating field direction, of course, no eddy current related signal component would be produced and reliable detection would not result. Accordingly, it is preferred to interrogate the marker along at least three directions and to require the production of at least an in-phase or an out-of-phase signal component upon interrogation in each direction.

In another embodiment, the orientation of the marker as it is passed through an interrogation zone may be determined. Since the eddy current related in-phase signal component is produced when the plane of the marker is perpendicular to the applied field, the orientation of the marker may be determined by noting the direction of the applied field when such signal components are produced. Furthermore, since the amplitude of the sensed signal components depends upon the extent of alignment of the marker with a given directional field, additional logic circuits may be provided to sense both the presence and relative amplitudes of the in-phase and out-of-phase components, and to associate each component with the directional field resulting in the production of that component in order to more precisely determine the orientation.

Figure 4:
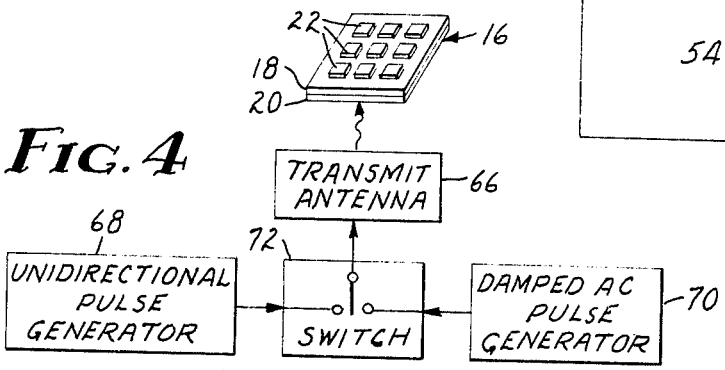
FIG. 4 is a block diagram of a device for desensitizing and sensitizing the marker shown in FIG. 2.

FIG. 4 shows another embodiment of the system of the present invention suitable for use with the marker shown in FIG. 2. Desensitization of such a marker requires that the elements 22 of the marker 16 be magnetized. Accordingly, another transmitting antenna 66 is provided which would typically be located in a book or object check-out unit adjacent a controlled passageway. The transmitting antenna is energized by a unidirectional pulse generator 68 or by a damped AC pulse generator 70, depending upon the position of switch 72. When a unidirectional pulse is applied from the pulse generator 68 to the transmitting antenna 66 and a marker 16 is proximate that antenna, the single polarity magnetic field thus produced substantially magnetically saturates the elements 22 of the marker 16. This leaves the elements 22 in a state of remanent magnetization, thereby biasing the ferromagnetic sheet 18, rendering the marker desensitized. To resensitize the marker 16, switch 72 is positioned to connect the damped AC pulse generator 70 to the transmitting antenna 66, thereby impressing on a marker 16 proximate that antenna a damped magnetic field which cycles the elements 22 through a series of minor hysteresis loops, leaving the elements in a demagnetized state.

What is claimed is:

1. A system for detecting the presence of an object within an interrogation zone comprising:

a. a marker carried by said object, which marker comprises a sheet including a laminate of a ferromagnetic layer and an electrically conductive layer wherein said ferromagnetic layer is characterized by an initial relative permeability in excess of 20,000, a maximum relative permeability in excess of 100,000 and a coercivity less than 0.3 $\sigma$e such that said sheet is capable of responding to a magnetic field having a major field component in one direction in an interrogation zone, which field varies at a predetermined rate of not less than 1 KHz, to cyclically enhance said field in the zone and wherein said electrically conductive layer is characterized by a resistivity of not greater than about 3.0 microhm-cm such that said sheet is capable of responding to another cyclical magnetic field having a major field component in a direction substantially normal to said one direction to diminish said another field in the zone;

b. means defining an interrogation zone;

c. means for sequentially producing in said zone at least three magnetic fields, the intensity of each field periodically varying at a predetermined rate of not less than 1 KHz, a major field component of each field within said zone being orthogonally disposed with respect to a major field component of the other two fields; and d. means for detecting in the vicinity of the interrogation zone a change in the magnetic field condition due to the presence of a marker in the zone resulting in a signal corresponding to said enhancement and diminishment occurring during at least two of said three produced sequential fields irrespective of the orientation of said marker within said zone.

2. A system according to claim 1, wherein said sheet comprises a ferromagnetic layer having at least two stable magnetic states, which layer is capable of being magnetically switched to any of said states to enhance said field to one degree in one stable state and to enhance said field to another degree when in another of said states, with the difference in the degree of enhancement of said field for said states being sufficient to be detected by said magnetic field sensing means.

3. A system according to claim 2, wherein one of said states corresponds to a desensitized state, said system further including means for desensitizing said marker to cause a said marker when placed within said zone to differently enhance said field.

4. A system according to claim 1, wherein said sequential field producing means sequentially produces three substantially uniaxial mutually orthogonal fields in the zone and wherein said detecting means comprises at least three magnetic field sensing means each of which is electrically balanced with respect to a corresponding sequentially produced field such that when no marker is present in the zone, the field from a given field producing means is nulled out, resulting in virtually no signal being produced in the cprresponding field sensing means.

5. A system according to claim 4, wherein said detecting means comprises means synchronized to the sequential field producing means for gating the field sensing means to enable the production of a signal from a given field sensing means only during a period when electrical energy is applied to a said corresponding field producing means.

6. A system according to claim 5, wherein the means for sequentially producing at least three magnetic fields comprises a periodically varying signal generator and means coupled thereto for sequentially switching the output of the generator to the field producing means, and wherein the field detecting means comprises a pulse-decoding means coupled to receive signals passed through said gating means and synchronized to the signal generator for sensing and distinguishing between such signals as are passed through the gating means, the peak intensity of which signals occur substantially in phase with the peak intensity of the corresponding periodic field variations, and between those signals such as are passed through the gating means, the peak intensity of which signals are substantially shifted in phase from the peak intensity of the corresponding periodic field variations, and an alarm logic means coupled to the pulse decoding means for producing an alarm signal in response to the occurrence of at least one repetitive signal sequence characterized by one signal component produced in response to one of said sequentially applied fields wherein the one component is substantially in phase with the phase of the applied field followed by two successive signal components produced in response to the other two sequentially applied fields wherein the two successive components are substantially shifted in phase with respect to the phase of the applied fields.

7. A method for detecting the presence of an object within an interrogation zone comprising:

a. providing a marker adapted to be carried by a said object, said marker comprising a sheet including a laminate of a ferromagnetic layer and an electrically conductive layer wherein said ferromagnetic layer is characterized by an initial relative permeability in excess of 20,000, a maximum relative permeability in excess of 100,000 and a coercivity less than 0.3 $\sigma e$ such that said sheet is capable of responding to a magnetic field having a major field component in one direction in an interrogation zone, which field varies at a predetermined rate of not less than 1 KHz, to cyclically enhance said field in the zone and wherein said electrically conductive layer is characterized by a resistivity of not greater than about 3.0 microhm-cm such that said sheet is capable of responding to another cyclical magnetic field having a major field component in a direction substantially normal to said one direction to diminish said another field in the zone;

b. sequentially producing in an interrogation zone at least three magnetic fields, the intensity of each field periodically varying at a predetermined rate of not less than 1 KHz, a major field component of each field within said zone being orthogonally disposed with respect to a major field component of the other two fields; and c. detecting in the vicinity of the interrogation zone a change in the magnetic field condition due to the presence of a marker in the zone resulting in a signal corresponding to said enhancement and diminishment occuring during at least two of said three produced sequential fields irrespective of the orientation of said marker within said zone.

8. In a system for detecting the presence of an object within an interrogation zone comprising:

a. a marker carried by said object, which marker is responsive to a cyclical uniaxial magnetic field in an interrogation zone varying at a predetermined rate of not less than 1 KHz applied to cyclically change the field in the zone;

b. means defining an interrogation zone;

c. means for sequentially producing in said zone at least three magnetic fields, the intensity of each field periodically varying at a predetermined rate of not less than 1 KHz, a major field component of each field within said zone being orthogonally disposed with respect to a major field component of the other two fields; and d. means for detecting in the vicinity of the interrogation zone the presence of cyclical changes in the field due to said marker, the improvement wherein the marker comprises a sheet having a laminate of a ferromagnetic layer and an electrically conductive layer wherein said ferromagnetic layer is characterized by an initial relative permeability in excess of 20,000, a maximum relative permeability in excess of 100,000 and a coercivity less than 0.3 $\sigma e$ such that said sheet is capable of responding to a magnetic field having a major field component in one direction in an interrogation zone, which field varies at a predetermined rate of not less than 1 KHz, to cyclically enhance said field in the zone and wherein said electrically conductive layer is characterized by a resistivity of not greater than about 3.0 microhm-cm such that said sheet is capable of responding to another cyclical magnetic field having a major field component in a direction substantially normal to said one direction to diminish said another field in the zone.

* * * * *